US010619124B2

(12) United States Patent
Piorkowski

(10) Patent No.: US 10,619,124 B2
(45) Date of Patent: Apr. 14, 2020

(54) COLOR CARE ADDITIVE COMPOSITIONS

(71) Applicant: Henkel IP & Holding GmbH, Duesseldorf (DE)

(72) Inventor: Daniel Thomas Piorkowski, Fairfield, CT (US)

(73) Assignee: Henkel IP & Holding GmbH (DE)

( * ) Notice: Subject to any disclaimer, the term of this patent is extended or adjusted under 35 U.S.C. 154(b) by 71 days.

(21) Appl. No.: 15/856,975

(22) Filed: Dec. 28, 2017

(65) Prior Publication Data

US 2018/0195024 A1 Jul. 12, 2018

Related U.S. Application Data

(60) Provisional application No. 62/443,367, filed on Jan. 6, 2017.

(51) Int. Cl.

| | |
|---|---|
| ***C11D 3/37*** | (2006.01) |
| ***C11D 3/04*** | (2006.01) |
| ***C11D 3/00*** | (2006.01) |
| ***C11D 3/50*** | (2006.01) |
| ***C11D 3/40*** | (2006.01) |
| ***C11D 17/00*** | (2006.01) |

(52) U.S. Cl.

CPC ..... *C11D 3/046* (2013.01); *C11D 3/001* (2013.01); *C11D 3/0015* (2013.01); *C11D 3/3723* (2013.01); *C11D 3/3776* (2013.01); *C11D 3/40* (2013.01); *C11D 3/50* (2013.01); *C11D 3/505* (2013.01); *C11D 17/0008* (2013.01)

(58) Field of Classification Search

CPC ..... C11D 3/001; C11D 3/3761; C11D 1/62; C11D 3/42; C11D 11/0017; C11D 3/0015; C11D 17/043

See application file for complete search history.

(56) References Cited

U.S. PATENT DOCUMENTS

| | | | | |
|---|---|---|---|---|
| 2,220,099 | A | 11/1940 | Guenther et al. | |
| 2,477,383 | A | 7/1949 | Lewis | |
| 3,929,678 | A | 12/1975 | Laughlin et al. | |
| 4,228,044 | A | 10/1980 | Cambre | |
| 4,291,071 | A | 9/1981 | Harris et al. | |
| 4,375,416 | A | 3/1983 | Crisp et al. | |
| 4,565,647 | A | 1/1986 | Llenado | |
| 4,973,416 | A | 11/1990 | Kennedy | |
| 5,132,036 | A | 7/1992 | Falou et al. | |
| 5,296,588 | A | 3/1994 | Au et al. | |
| 5,336,765 | A | 8/1994 | Au et al. | |
| 5,386,018 | A | 1/1995 | Au et al. | |
| 5,389,279 | A | 2/1995 | Au et al. | |
| 5,401,426 | A | 3/1995 | Gerling | |
| 5,401,839 | A | 3/1995 | Au et al. | |
| 6,037,319 | A | 3/2000 | Dickler et al. | |
| 6,057,280 | A | 5/2000 | Huish et al. | |
| 6,288,020 | B1 | 9/2001 | Huish et al. | |
| 6,407,050 | B1 | 6/2002 | Huish et al. | |
| 6,468,956 | B1 | 10/2002 | Huish et al. | |
| 6,509,310 | B1 | 1/2003 | Huish et al. | |
| 6,534,464 | B1 | 3/2003 | Huish et al. | |
| 6,683,039 | B1 | 1/2004 | Huish et al. | |
| 6,764,989 | B1 | 7/2004 | Huish et al. | |
| 6,770,611 | B2 | 8/2004 | Huish et al. | |
| 6,780,830 | B1 | 8/2004 | Huish et al. | |
| 7,387,992 | B2 | 6/2008 | Hsu et al. | |
| 7,479,165 | B2 | 1/2009 | Birker et al. | |
| 8,357,647 | B2 | 1/2013 | Sharma et al. | |
| 2003/0130152 | A1* | 7/2003 | Heinzman | C11D 1/65 510/329 |
| 2003/0216278 | A1* | 11/2003 | Depoot | C11D 1/04 510/421 |
| 2009/0042766 | A1* | 2/2009 | Mayer | C11D 3/001 510/516 |
| 2012/0122747 | A1 | 5/2012 | Nekmard et al. | |

FOREIGN PATENT DOCUMENTS

| | | | |
|---|---|---|---|
| AU | 1781395 | A | 12/1995 |
| WO | 9412511 | A1 | 6/1994 |

* cited by examiner

*Primary Examiner* — John R Hardee

(74) *Attorney, Agent, or Firm* — Bojuan Deng

(57) ABSTRACT

Disclosed are liquid fabric conditioner compositions, softening compositions, scent boosting compositions, and liquid laundry detergent compositions including color care additives. Also disclosed are methods of conditioning fabrics, softening fabrics, boosting scent in fabrics, and laundering fabrics using the disclosed compositions. The application also relates to unit dose packs including the disclosed compositions.

19 Claims, No Drawings

COLOR CARE ADDITIVE COMPOSITIONS

FIELD OF THE INVENTION

The present disclosure relates to liquid fabric conditioner compositions, softening compositions, scent boosting compositions, and liquid laundry detergent compositions comprising color care additives and uses for those compositions.

BACKGROUND OF THE INVENTION

Chlorine in laundry wash liquor causes fabrics to fade. Higher value laundry detergents and fabric softeners may include chlorine scavengers to associate with chlorine with the goal of minimizing color fading.

Traditional chlorine scavengers, such as ammonium chloride or polyethyleneimines (PEIs), can be used to scavenge chlorine. But, incorporating ammonium chloride or polyethyleneimines into compositions may have negative effects on the product's viscosity, including thinning the product to an unacceptable level.

While prior disclosures have used PEI in a granular laundry detergent composition, these granular laundry detergent compositions have identified problems with chlorine scavenging efficacy for PEIs having an average molecular weight above 1000 or for PEIs with tertiary amine groups (See, e.g., Australian Patent No. 17813/95). Other examples of using PEI in laundry detergent compositions have shown that low amounts (e.g., from about 0.5% to about 1% by weight of the formulation) may be effective in removing certain difficult to remove stains, but PEI in an amount less than about 0.5% by weight can be ineffective and PEI in an amount greater than about 1-2% by weight may cause stains to fix to fabrics (See, e.g., U.S. 2012/0122747).

Although some manufacturers have attempted to modify chlorine scavenging compositions to enhance fabric care benefit, these methods have been expensive and failed to provide an adequate overall desirable fabric care profile.

BRIEF SUMMARY OF THE INVENTION

The present disclosure relates to liquid fabric conditioner compositions, softening compositions, scent boosting compositions, and liquid laundry detergent compositions comprising color care additives. Also disclosed are methods of conditioning fabrics, softening fabrics, boosting scent in fabrics, and laundering fabrics using the disclosed compositions. The application also relates to unit dose packs comprising the disclosed compositions.

In some embodiments, the liquid fabric conditioner composition comprises: from about 2 to about 40 weight percent a fabric softener and from about 0.0001 to about 5 weight percent a color care additive mixture. The color care additive mixture comprises at least two color care additives, or at least three color care additives. The color care additive mixture may be present in an amount from about 0.005 to about 1 weight percent, or from about 0.01 to about 0.05 weight percent.

In another embodiment, the softening composition comprises: from about 2 to about 40 weight percent a fabric softener and from about 0.001 to about 5 weight percent a color care additive mixture. The color care additive mixture comprises at least two color care additives, or at least three color care additives. The color care additive mixture may be present in an amount from about 0.005 to about 1 weight percent, or from about 0.01 to about 0.05 weight percent. In some embodiments, the softening composition is a liquid or a solid.

In another embodiment, the scent boosting composition comprises: from about 0.1 to about 15 weight percent a scent booster and from about 0.001 to about 5 weight percent a color care additive mixture. The color care additive mixture comprises at least two color care additives, or at least three color care additives. The color care additive mixture may be present in an amount from about 0.005 to about 1 weight percent, or from about 0.01 to about 0.05 weight percent. In some embodiments, the scent boosting composition is a liquid or a solid.

In another embodiment, the liquid detergent composition comprises: an effective amount of a detergent surfactant and a color care additive mixture. In one embodiment, the liquid detergent composition comprises: from about 1 to about 75 weight percent a detergent surfactant and from about 0.001 to about 5 weight percent a color care additive mixture. The color care additive mixture comprises at least two color care additives, or at least three color care additives. The color care additive mixture may be present in an amount from about 0.005 to about 1 weight percent, or from about 0.01 to about 0.05 weight percent.

In an embodiment, the color care additive is selected from the group consisting of (i) ammonium chloride, (ii) a polyvinylpyrrolidone homopolymer, (iii) a vinylimidazole homopolymer, (iv) a polyvinylpyrrolidone-vinylimidazole copolymer, and (v) a polyethyleneimine (PEI), a polyethyleneimine salt, or mixtures thereof. In an embodiment, the color care additive mixture comprises (i) ammonium chloride and (ii) a polyvinylpyrrolidone-vinylimidazole copolymer. In some embodiments, the color care additive mixture comprises (i) a polyvinylpyrrolidone-vinylimidazole copolymer and (ii) a polyethyleneimine (PEI), a polyethyleneimine salt, or mixtures thereof. In another embodiment, the color care additive mixture comprises (i) ammonium chloride, (ii) a polyvinylpyrrolidone-vinylimidazole copolymer, and (iii) a polyethyleneimine (PEI), a polyethyleneimine salt, or mixtures thereof. In an embodiment, the PEI, PEI salt, or mixtures thereof has an average molecular weight of between about 120 daltons and 25 kilodaltons and a charge density of between 12-20 meq/g.

In one embodiment, the fabric softener is a polysiloxane, a textile-softening clay, a cationic polymer, a cellulase enzyme, a quaternary cationic ammonium, or any combination thereof. In another embodiment, the textile-softening clay is a smectite clay. Smectite clays include Bentonite clay, Beidellite clay, a Hectorite clay, a Laponite clay, a Montmorillonite clay, a Nontronite clay, a Saponite clay, a Sauconite, clay, or any combination thereof.

In an embodiment, the composition comprises a colorant, such as a colorant selected from the group consisting of Acid Blue 80, Yellow 5, and Red 40. The colorant may be present in an amount of at least 0.005 weight percent, at least 0.001 weight percent, at least 0.05 weight percent, at least 0.1 weight percent, or at least 0.5 weight percent.

In one embodiment, the composition comprises a colorant stabilizer, including a colorant stabilizer selected from the group consisting of formic acid, citric acid, lactic acid, acetic acid, ascorbic acid, erythorbic acid, any derivative thereof, or any combination thereof.

In some embodiments, the scent booster is selected from the group consisting of a perfume, an oil, a fragrance, and combinations thereof.

In an embodiment, the detergent surfactant is selected from the group consisting of anionic surfactants, nonionic surfactants, zwitterionic surfactants, ampholytic surfactants, and cationic surfactants.

In some embodiments, the composition comprises solvents, rinse aids, hydrotropes, solubilizing agents, processing aids, soil-suspending agents, corrosion inhibitors, fillers, carriers, germicides, pH-adjusting agents, perfumes, static control agents, thickening agents, abrasive agents, viscosity control agents, solubilizing/clarifying agents, sunscreens/UV absorbers, phase regulants, foam boosting/stabilizing agents, antioxidants, metal ions, buffering agents, color speckles, encapsulation agents, deflocculating polymers, skin protective agents, color care agents, and combinations thereof.

In some embodiments, the composition comprises a scent booster, a softening liquid, a detergency builder, or a colorant stabilizer. In another embodiment, the detergency builder is selected from the group consisting of zeolite; alkali metal silicates; alkali metal carbonates; alkali metal phosphates; alkali metal polyphosphates; alkali metal phosphonates; alkali metal polyphosphonic acids; $C_8$-$C_{18}$ alkyl monocarboxylic acids, polycarboxylic acids, alkali metal, ammonium or substituted ammonium salts thereof; and mixtures thereof. The detergency builder may be present in an amount from about 1 to about 80 weight percent.

In another embodiment, the present disclosure provides a unit dose pack comprising the liquid fabric conditioner composition, the softening composition, the scent boosting composition, or the liquid detergent composition. The unit dose pack comprises at least one chamber.

In another embodiment, the present disclosure provides a method of conditioning fabrics, comprising contacting said fabrics with the liquid fabric conditioner. In one embodiment, the present disclosure provides a method of softening fabrics, comprising contacting said fabrics with the softening composition. In one embodiment, the present disclosure provides a method of boosting scent in fabrics, comprising contacting said fabrics with the scent boosting composition. In one embodiment, the present disclosure provides a method of laundering fabrics, comprising contacting said fabrics with the liquid detergent composition.

DETAILED DESCRIPTION OF THE INVENTION

Various examples and embodiments of the subject matter disclosed here are possible and will be apparent to a person of ordinary skill in the art, given the benefit of this disclosure. In this disclosure reference to "some embodiments," "certain embodiments," "certain exemplary embodiments" and similar phrases each means that those embodiments are non-limiting examples of the inventive subject matter, and there are alternative embodiments which are not excluded.

The articles "a," "an," and "the" are used herein to refer to one or to more than one (i.e., to at least one) of the grammatical object of the article. By way of example, "an element" means one element or more than one element.

The word "comprising" is used in a manner consistent with its open-ended meaning, that is, to mean that a given product or process can optionally also have additional features or elements beyond those expressly described. It is understood that wherever embodiments are described with the language "comprising," otherwise analogous embodiments described in terms of "consisting of" and/or "consisting essentially of" are also contemplated and within the scope of this disclosure.

As used herein, the term "about" means±10% of the noted value. By way of example only, a composition comprising "about 30 weight percent" of a compound could include from 27 weight percent of the compound up to and including 33 weight percent of the compound.

As used herein, the term "color care additive" means a compound having the ability to prevent color fading or color shifting of the dyes within the fabric or to protect colored fabrics in a wash, such as the ability to improve, enhance, or modify stiffness (resilience), softness, smoothness, drape, and/or wrinkle recovery (elastic recoverability) properties.

As used herein, the term "scent booster" means any material that may improve the scent of a fabric, such as the ability to mask, reduce, or eliminate malodor.

Color Care Additives

Color care additives of the present disclosure are compounds having the ability to prevent color fading or color shifting of the dyes within the fabric or to protect colored fabrics in a wash, such as the ability to improve, enhance, or modify stiffness (resilience), softness, smoothness, drape, and/or wrinkle recovery (elastic recoverability) properties. In one embodiment, a color care additive has the ability to protect colored fabrics in a chlorinated wash. In another embodiment, a color care additive has the ability to protect colored fabrics in a non-chlorinated wash. A color care additive mixture comprises at least two color care additives, such as at least three color care additives.

Color care additives of the present disclosure include chlorine scavengers. In an embodiment, the color care additive may be ammonium chloride, a polyvinylpyrrolidone homopolymer, a vinylimidazole homopolymer, a polyvinylpyrrolidone-vinylimidazole copolymer, monoethanolamine, iminodisuccinic acid, and a polyethyleneimine (PEI), a polyethyleneimine salt, or mixtures thereof.

Polyvinylpyrrolidone-vinylimidazole copolymers are suitable for use in the present disclosure. SOKALAN® HP56K is an example of a commercially available suitable polyvinylpyrrolidone-vinylimidazole copolymer.

PEIs: The polyethyleneimines (PEIs) suitable for use as a color care additive of the present disclosure can have the following general formula, although the actual formula may vary:

$$(\text{—NHCH}_2\text{CH}_2\text{—})_x[\text{—N(CH}_2\text{CH}_2\text{NH}_2)\text{CH}_2\text{CH}_2\text{—}]_y$$

wherein x is an integer from about 1 to about 120,000, such as from about 2 to about 60,000, and from about 3 to about 24,000 and y is an integer from about 1 to about 60,000, such as from about 2 to about 30,000, and from about 3 to about 12,000. Specific examples of polyethyleneimines that may be used are PEI-3, PEI-7, PEI-15, PEI-30, PEI-45, PEI-100, PEI-300, PEI-500, PEI 600, PEI-700, PEI-800, PEI-1000, PEI-1500, PEI-1800, PEI-2000, PEI-2500, PEI-5000, PEI-10,000, PEI-25,000, PEI 50,000, PEI-70,000, PEI-500,000, PEI-5,000,000 and the like, wherein the integer represents the average molecular weight of the polymer. PEIs which are designated as such are available through a variety of commercial sources, including BASF, Aldrich, and the like. In one embodiment, PEIs for use in the present compositions and methods are PEIs having a molecular weight between about 120 daltons and about 25,000 daltons; between about 120 daltons and about 20,000 daltons, between about 120 daltons and about 15,000 daltons, between about 120 daltons and about 10,000 daltons, between about 120 daltons and about 7,500 daltons; between about 800 daltons and about 5000 daltons; between about 120 daltons and about 2,500 daltons; between about 120 daltons and about 1,000 daltons. Examples of suitable such PEI polymers for use in the compositions and methods of the present disclosure are PEI-800 (e.g., LUPASOL®FG; BASF), PEI-25,000 (LUPASOL®WF; BASF), and members of the SOKALAN® family of polymers (BASF), including but not limited to SOKALAN® HP20, SOKALAN® HP22 G, and the like.

PEIs are usually highly branched polyamines characterized by the empirical formula $(C_2H_5N)_n$ with a molecular mass of 43.07 (as repeating units). They are commercially prepared by acid-catalyzed ring opening of ethyleneimine, also known as aziridine. (The latter, ethyleneimine, is prepared through the sulfuric acid esterification of ethanolamine). The reaction scheme is shown below:

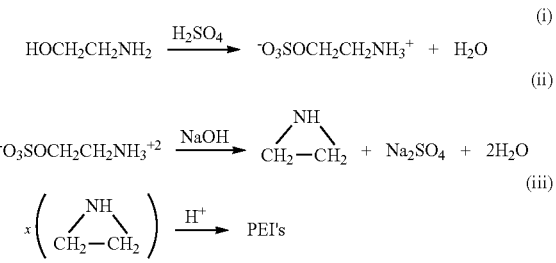

As noted above, PEIs can be prepared as a wide range of molecular weights and product activities. PEIs are commercially available from the BASF Corporation under the trade names LUPASOL® (also sold as POLYMIN®) and SOKALAN®. PEIs are also commercially available from Polymer Enterprises or Nippon Soda (of Japan) under the trade name EPOMIN®. Other frequently used commercial trade names for PEIs suitable for use in present disclosure include, but are not limited to, POLYAZINIDINE®, CORCAT®, MONTEK®, and the like.

The amine groups of PEI exist mainly as a mixture of primary, secondary, and tertiary groups in the ratio of about 1:1:1 to about 1:2:1 with branching every 3 to 3.5 nitrogen atoms along a chain segment. Because of the presence of amine groups, PEI can be protonated with acids to form a PEI salt from the surrounding medium resulting in a product that is partially or fully ionized depending on pH. For example, about 73% of PEI is protonated at pH 2, about 50% of PEI is protonated at pH 4, about 33% of PEI is protonated at pH 5, about 25% of PEI is protonated at pH 8, and about 4% of PEI is protonated at pH 10. In general, PEIs can be purchased as their protonated or unprotonated form with and without water.

An example of a segment of a branched protonated polyethyleneimine (PEI salt) is shown below:

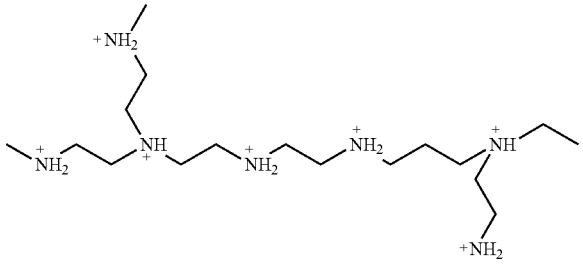

The counterion of each protonated nitrogen center is balanced with an anion of an acid obtained during neutralization.

Examples of protonated PEI salts include, but are not limited to, PEI-hydrochloride salt, PEI-sulfuric acid salt, PEI-nitric acid salt, PEI-acetic acid salt, PEI fatty acid salt, and the like. In fact, any acid can be used to protonate PEIs resulting in the formation of the corresponding PEI salt compound.

It should be noted that linear polyethyleneimines as well as mixtures of linear and branched polyethyleneimines are useful in the compositions of the present disclosure. Linear PEIs are obtained by cationic polymerization of oxazoline and oxazine derivatives.

It has been unexpectedly discovered that the addition of a polyvinylpyrrolidone-vinylimidazole copolymer to a composition of the present disclosure comprising ammonium chloride and/or a PEI, PEI salt, or mixtures thereof provides beneficial viscosifying effects. The polyvinylpyrrolidone-vinylimidazole copolymer thickens a composition of the present disclosure; without the use of a polyvinylpyrrolidone-vinylimidazole copolymer, a system containing ammonium chloride and/or a PEI is unstable. For example, when added to a system comprising (1) ammonium chloride, (2) a PEI, a PEI salt, or mixtures thereof, or (3) ammonium chloride and a PEI, a PEI salt, or mixtures thereof, the viscosity of the composition of the present disclosure increases back to an acceptable range. For example, the combination of a polyvinylpyrrolidone-vinylimidazole copolymer (such as Sokalan® HP56K) with ammonium chloride and/or a PEI may allow the product to have a "2 in 1" color care benefit. Also, the combination of a polyvinylpyrrolidone-vinylimidazole copolymer (such as Sokalan® HP56K) with ammonium chloride and/or a PEI may allow the product to pass quality control, when the composition would have otherwise failed quality control for having too low a viscosity without the polyvinylpyrrolidone-vinylimidazole copolymer. Accordingly, color care additive mixtures of the present disclosure provide both unexpected fabric care benefits and viscosity benefits. As shown in Example 1, there may be an optimal ratio of between 1:2 to 1:6 Ammonium Chloride:Sokalan® HP56K to provide enhanced stability for a composition comprising a color care additive mixture.

Color care additives of the present disclosure provide a fabric care benefit, a softening benefit, and/or a scent boosting benefit. A fabric care benefit may include the ability to associate with chlorine so color fading is minimized. Color care additives of the present disclosure allow for products to recite a "2 in 1" technology, as both fabric care and softening benefits may be provided by the compositions comprising the color care additives. In an embodiment, the fabric care benefit is an improvement, enhancement, or modification in one or more of drape, stiffness, smoothness, wrinkle recovery, and softness. As shown in Example 4, a color care additive may lead to improvements in drape, stiffness, and softness.

Colorants

It has been unexpectedly discovered that the addition of a colorant with a color care additive will boost the chlorine scavenging efficacy of a liquid fabric conditioner composition, a softening composition, a scent boosting composition, and a liquid detergent composition of the present disclosure.

A colorant may be present in the composition in an amount of at least 0.005 weight percent of the total formulation. This includes, for example, at least 0.01 weight percent, 0.02 weight percent, 0.03 weight percent, 0.04 weight percent, 0.05 weight percent, 0.075 weight percent, 0.1 weight percent, 0.2 weight percent, 0.3 weight percent, 0.4 weight percent, 0.5 weight percent, 0.6 weight percent, 0.7 weight percent, 0.8 weight percent, 0.9 weight percent, 1 weight percent, 1.5 weight percent, 2 weight percent, 2.5 weight percent, 3 weight percent, 3.5 weight percent, 4 weight percent, 4.5 weight percent, and 5 weight percent.

A colorant may include any colorant known in the art. Suitable dyes include dyes that contain an azo-bond or a primary or secondary amine. These may include, for example, Acid Blue 80, Yellow 5, and Red 40. The inventors have unexpectedly discovered that certain colorants may scavenge chloride. As shown in Example 4 and Table 5, Acid Blue 9 did not scavenge any chlorine, but Acid Blue 80, Yellow 5, and Red 40 scavenged 0.31, 0.27, and 0.14 ppm of the 1 ppm chlorine dosed into the system.

The chlorine scavenging benefit from combining a colorant and a color care additive can be optimized by combining specific colorants with specific color care additives to create the most efficient formulation. For example, combining Acid Blue 80 with a PEI provides an additional color care benefit, as compared to using Acid Blue 9 with a PEI. Additionally, depending on the amount of colorant in the composition, it may be more cost effective to use more colorant than color care additive to gain a color care benefit, as color care additives may be more expensive than colorants. Also, because colorants are typically more stable and less reactive than color care additives, they may be preferred in certain product formulations.

Liquid Fabric Conditioner Compositions

Liquid fabric conditioner compositions of the present disclosure comprise from about 2 to about 40 weight percent a fabric softener and from about 0.0001 to about 5 weight percent a color care additive mixture.

A fabric softener is present in the liquid fabric conditioner composition in an amount from about 2 to about 40 weight percent of the total formulation. This includes, for example, from about 5 to about 35 weight percent, from about 10 to about 30 weight percent, and from about 15 to about 25 weight percent. This includes, for example, about 2 weight percent, about 3 weight percent, about 4 weight percent, about 5 weight percent, about 7.5 weight percent, about 10 weight percent, about 12.5 weight percent, about 15 weight percent, about 17.5 weight percent, about 20 weight percent, about 22.5 weight percent, about 25 weight percent, about 27.5 weight percent, about 30 weight percent, about 32.5 weight percent, about 35 weight percent, about 37.5 weight percent, and about 40 weight percent.

The fabric softener may be a polysiloxane, a textile-softening clay, a cationic polymer, a cellulase enzyme, a quaternary cationic ammonium, or any combination thereof. If the fabric softener is a textile-softening clay, it may be a smectite clay, including a Bentonite clay, Beidellite clay, a Hectorite clay, a Laponite clay, a Montmorillonite clay, a Nontronite clay, a Saponite clay, a Sauconite, clay, or any combination thereof. Clay softeners can be used in combination with amine and cationic softeners, as disclosed, for example, in U.S. Pat. No. 4,375,416 and U.S. Pat. No. 4,291,071. Mixtures of cellulase enzymes (e.g., CAREZYME, Novo) and clays are also useful as high-performance fabric softeners. Various nonionic and cationic materials can be added to enhance static control such as $C_8$-$C_{18}$ dimethylamino propyl glucamide, $C_8$-$C_{18}$ trimethylamino propyl glucamide ammonium chloride and the like.

A color care additive mixture is present in the liquid fabric conditioner composition in an amount from about 0.0001 to about 5 weight percent of the total formulation. This includes, for example, from about 0.005 to about 1 weight percent, from about 0.01 to about 0.05 weight percent, and from about 0.1 to about 0.5 weight percent. This includes, for example, about 0.0001 weight percent, about 0.005 weight percent, about 0.001 weight percent, about 0.05 weight percent, about 0.1 weight percent, about 0.2 weight percent, about 0.3 weight percent, about 0.4 weight percent, about 0.5 weight percent, about 0.6 weight percent, about 0.7 weight percent, about 0.8 weight percent, about 0.9 weight percent, about 1 weight percent, about 1.5 weight percent, about 2 weight percent, about 2.5 weight percent, about 3 weight percent, about 3.5 weight percent, about 4 weight percent, about 4.5 weight percent, and about 5 weight percent.

The color care additive mixture comprises at least two color care additives. In an embodiment, the color care additive may be ammonium chloride, a polyvinylpyrrolidone homopolymer, a vinylimidazole homopolymer, a polyvinylpyrrolidone-vinylimidazole copolymer, monoethanolamine, iminodisuccinic acid, and a polyethyleneimine (PEI), a polyethyleneimine salt, or mixtures thereof. For example, the color care additive mixture may comprise ammonium chloride and a polyvinylpyrrolidone-vinylimidazole copolymer, such as a color care additive mixture comprising ammonium chloride and Sokalan® HP56K. The color care additive mixture may comprise a polyvinylpyrrolidone-vinylimidazole copolymer and a PEI, a PEI salt, or mixtures thereof, such as a color care additive mixture comprising Sokalan® HP56K and Lupasol® FG. The color care additive mixture may comprise at least three color care additives. For example, the color care additive mixture may comprise ammonium chloride, a polyvinylpyrrolidone-vinylimidazole copolymer, and a PEI, a PEI salt, or mixtures thereof, such as a color care additive mixture comprising ammonium chloride, Sokalan® HP56K, and Lupasol® FG.

It has been unexpectedly discovered that the addition of a polyvinylpyrrolidone-vinylimidazole copolymer to a liquid fabric conditioner composition comprising ammonium chloride and/or a PEI, PEI salt, or mixtures thereof provides beneficial viscosifying effects. The polyvinylpyrrolidone-vinylimidazole copolymer thickens the liquid fabric conditioner composition; without the use of a polyvinylpyrrolidone-vinylimidazole copolymer, a system containing ammonium chloride or a PEI is unstable. For example, when added to a system comprising (1) ammonium chloride, (2) a PEI, a PEI salt, or mixtures thereof, or (3) ammonium chloride and a PEI, a PEI salt, or mixtures thereof, the viscosity of the liquid fabric conditioner composition increases back to an acceptable range (i.e., 70 to 300 cP). For example, the combination of a polyvinylpyrrolidone-vinylimidazole copolymer (such as Sokalan® HP56K) with ammonium chloride and/or a PEI may allow the product to have a "2 in 1" color care benefit. Also, the combination of a polyvinylpyrrolidone-vinylimidazole copolymer (such as Sokalan® HP56K) with ammonium chloride and/or a PEI may allow the product to pass quality control, when the composition would have otherwise failed quality control for having too low a viscosity without the polyvinylpyrrolidone-vinylimidazole copolymer.

As shown in Example 1, adding Sokalan HP56K to fabric conditioners containing $NH_4Cl$ increased the viscosity of the product to an acceptable level (i.e. 70 to 300 cP). Sokalan HP56K also enhanced the overall stability of the product by increasing the time to failure (i.e., solution instability or settling) from 0 days to more than 8 weeks in storage at multiple temperatures. The Instability Index numbers shown in Example 1 show that there may be an optimal ratio of between 1:2 to 1:6 Ammonium Chloride:Sokalan® HP56K to provide enhanced stability. As shown in Example 2, there is an advantage of using Sokalan HP56K with Ammonium Chloride or Lupasol FG in a Liquid Fabric Conditioner. For the samples including Sokalan HP56K with either Ammonium Chloride or Lupasol FG, the slope of viscosity reduction was not as steep as the sample having only calcium chloride. This showed a reduction in the risk of improperly modifying viscosity in a liquid fabric conditioner composition and showed a more robust formula for viscosity adjustment.

Also disclosed is a method of conditioning fabrics comprising contacting said fabrics with the liquid fabric conditioner compositions disclosed herein. In an embodiment, conditioning fabrics comprises agitating fabrics in an aqueous solution containing the liquid fabric conditioner composition.

Softening Compositions

Softening compositions of the present disclosure comprise from about 2 to about 40 weight percent a fabric softener and from about 0.001 to about 5 weight percent a color care additive mixture.

A fabric softener is present in the softening composition in an amount from about 2 to about 40 weight percent of the total formulation. This includes, for example, from about 5 to about 35 weight percent, from about 10 to about 30 weight percent, and from about 15 to about 25 weight percent. This includes, for example, about 2 weight percent, about 3 weight percent, about 4 weight percent, about 5 weight percent, about 7.5 weight percent, about 10 weight percent, about 12.5 weight percent, about 15 weight percent, about 17.5 weight percent, about 20 weight percent, about 22.5 weight percent, about 25 weight percent, about 27.5 weight percent, about 30 weight percent, about 32.5 weight percent, about 35 weight percent, about 37.5 weight percent, and about 40 weight percent.

A color care additive mixture is present in the softening composition in an amount from about 0.0001 to about 5 weight percent of the total formulation. This includes, for example, from about 0.005 to about 1 weight percent, from about 0.01 to about 0.05 weight percent, and from about 0.1 to about 0.5 weight percent. This includes, for example, about 0.0001 weight percent, about 0.005 weight percent, about 0.001 weight percent, about 0.05 weight percent, about 0.1 weight percent, about 0.2 weight percent, about 0.3 weight percent, about 0.4 weight percent, about 0.5 weight percent, about 0.6 weight percent, about 0.7 weight percent, about 0.8 weight percent, about 0.9 weight percent, about 1 weight percent, about 1.5 weight percent, about 2 weight percent, about 2.5 weight percent, about 3 weight percent, about 3.5 weight percent, about 4 weight percent, about 4.5 weight percent, and about 5 weight percent.

A colorant may be present in the softening composition in an amount of at least 0.005 weight percent of the total formulation. This includes, for example, at least 0.01 weight percent, 0.05 weight percent, 0.75 weight percent, 0.1 weight percent, 0.2 weight percent, 0.3 weight percent, 0.4 weight percent, 0.5 weight percent, 0.6 weight percent, 0.7 weight percent, 0.8 weight percent, 0.9 weight percent, 1 weight percent, 1.5 weight percent, 2 weight percent, 2.5 weight percent, 3 weight percent, 3.5 weight percent, 4 weight percent, 4.5 weight percent, and 5 weight percent.

It has been unexpectedly discovered that the addition of a colorant with a color care additive will boost the chlorine scavenging efficacy of a softening composition of the present disclosure. Accordingly, the softening compositions of the present disclosure have synergistic chlorine scavenging efficacy.

Also disclosed is a method of softening fabrics, comprising contacting said fabrics with the softening compositions disclosed herein. In an embodiment, softening fabrics comprises agitating fabrics in an aqueous solution containing the softening composition.

Scent Boosting Compositions

Scent boosting compositions of the present disclosure comprise from about 0.1 to about 15 weight percent a scent booster and from about 0.001 to about 5 weight percent a color care additive mixture.

A scent booster includes any material that may improve the scent of a fabric, such as the ability to mask, reduce, or eliminate a malodor. Masking a malodor means that the masking compound has a more distinct odor than the malodor, so as to cover up or overpower the scent of the malodor. Reducing a malodor means that the malodor has a less intense scent, so as to provide a less noticeable malodor scent. Eliminating a malodor means remove the scent of the malodor. In one embodiment, the scent booster is a perfume. In another embodiment, the scent booster is an oil, such as a neat oil, or a fragrance, such as an encapsulated fragrance.

The perfume can comprise an ester, an ether, an aldehyde, a ketone, an alcohol, a hydrocarbon, or any combination thereof.

The perfume can have, for example, a musky scent, a putrid scent, a pungent scent, a camphoraceous scent, an ethereal scent, a floral scent, a peppermint scent, a citrus scent, a fruity scent, or any combination thereof.

In one embodiment, the perfume can comprise methyl formate, methyl acetate, methyl butyrate, ethyl butyrate, isoamyl acetate, pentyl butyrate, pentyl pentanoate, octyl acetate, myrcene, geraniol, nerol, citral, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, indole, pyridine, furaneol, 1-hexanol, cis-3-hexenal, furfural, hexyl cinnamaldehyde, fructone, hexyl acetate, ethyl methyl phenyl glycidate, dihydrojasmone, oct-1-en-3-one, 2-acetyl-1-pyrroline, 6-acetyl-2,3,4,5-tetrahydropyridine, gamma-decalactone, gamma-nonalactone, delta-octalone, jasmine lactone, massoia lactone, wine lactone, sotolon, grapefruit mercaptan, methanthiol, methyl phosphine, dimethyl phosphine, nerolin, 2,4,6-trichloroanisole, or any combination thereof.

In one embodiment, the perfume can contain, for example, a linear terpene, a cyclic terpene, an aromatic compound, a lactone, a thiol, or any combination thereof.

In one embodiment, the perfume is High Five ACM 190991 (Firmenich), Mayflowers TD 485531 EB (Firmenich), or any combination thereof. Other art-known fragrances, or any fragrance commercially available from a fragrance supplier (e.g. Firmenich, Givaudan, etc.), or combinations of such fragrances, may also suitably be used in the compositions disclosed herein.

At least some of the perfume can be encapsulated in a microcapsule. In one embodiment, all of the perfume can be encapsulated in microcapsules. The microcapsules can be water-soluble or water-insoluble.

A scent booster is present in the scent boosting composition in an amount from about 0.1 to about 15 weight percent of the total formulation. This includes, for example, from about 0.5 to about 10 weight percent, and from about 1 to about 5 weight percent. This includes, for example, about 0.1 weight percent, about 0.5 weight percent, about 0.75 weight percent, about 1 weight percent, about 2 weight percent, about 3 weight percent, about 4 weight percent, about 5 weight percent, about 6 weight percent, about 7 weight percent, about 8 weight percent, about 9 weight percent, about 10 weight percent, about 11 weight percent, about 12 weight percent, about 13 weight percent, about 14 weight percent, and about 15 weight percent.

A color care additive mixture is present in the softening composition in an amount from about 0.0001 to about 5 weight percent of the total formulation. This includes, for example, from about 0.005 to about 1 weight percent, from about 0.01 to about 0.05 weight percent, and from about 0.1 to about 0.5 weight percent. This includes, for example, about 0.0001 weight percent, about 0.005 weight percent, about 0.001 weight percent, about 0.05 weight percent, about 0.1 weight percent, about 0.2 weight percent, about 0.3 weight percent, about 0.4 weight percent, about 0.5 weight percent, about 0.6 weight percent, about 0.7 weight percent, about 0.8 weight percent, about 0.9 weight percent, about 1 weight percent, about 1.5 weight percent, about 2 weight percent, about 2.5 weight percent, about 3 weight percent, about 3.5 weight percent, about 4 weight percent, about 4.5 weight percent, and about 5 weight percent.

A colorant may be present in the scent boosting composition in an amount of at least 0.005 weight percent of the total formulation. This includes, for example, at least 0.01 weight percent, 0.05 weight percent, 0.75 weight percent, 0.1 weight percent, 0.2 weight percent, 0.3 weight percent, 0.4 weight percent, 0.5 weight percent, 0.6 weight percent, 0.7 weight percent, 0.8 weight percent, 0.9 weight percent, 1 weight percent, 1.5 weight percent, 2 weight percent, 2.5 weight percent, 3 weight percent, 3.5 weight percent, 4 weight percent, 4.5 weight percent, and 5 weight percent.

It has been unexpectedly discovered that the addition of a colorant with a color care additive will boost the chlorine scavenging efficacy of a scent boosting composition of the present disclosure. Accordingly, the scent boosting compositions of the present disclosure have synergistic chlorine scavenging efficacy.

Also disclosed is a method of boosting scent in fabrics, comprising contacting said fabrics with the scent boosting compositions disclosed herein. In an embodiment, boosting scent in fabrics comprises agitating fabrics in an aqueous solution containing the scent boosting composition.

Liquid Laundry Detergent Composition

Liquid laundry detergent compositions of the present disclosure comprise an effective amount of a detergent surfactant and a color care additive mixture. In an embodiment, the liquid laundry detergent compositions comprise from about 1 to about 75 weight percent a detergent surfactant and from about 0.001 to about 5 weight percent a color care additive mixture.

a. Detergent Surfactant (a) A detergent surfactant is present in the liquid laundry detergent composition in an amount from about 1 to about 75 weight percent of the total formulation. This includes, for example, from about 5 to about 70 weight percent, from about 10 to about 65 weight percent, from about 15 to about 60 weight percent, from about 20 to about 55 weight percent, from about 25 to about 50 weight percent, from about 30 to about 45 weight percent, and from about 35 to about 40 weight percent. This includes, for example, about 5 weight percent, about 10 weight percent, about 15 weight percent, about 20 weight percent, about 25 weight percent, about 25 weight percent, about 30 weight percent, about 35 weight percent, about 40 weight percent, about 45 weight percent, about 50 weight percent, about 55 weight percent, about 60 weight percent, about 65 weight percent, about 70 weight percent, and about 75 weight percent.

A. Nonionic Surfactants

Suitable nonionic surfactants are generally disclosed in U.S. Pat. No. 3,929,678, at column 13, line 14 through column 16, line 6, incorporated herein by reference. Classes of useful nonionic surfactants include:

1. The polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to from about 5 to about 25 moles of ethylene oxide per mole of alkyl phenol. Examples of compounds of this type include nonyl phenol condensed with about 9.5 moles of ethylene oxide per mole of phenol; dodecyl phenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal CO-630, marketed by the GAF Corporation; and Triton X-45, X-114, X-100, and X-102, all marketed by the Rohm & Haas Company.

2. The condensation products of aliphatic alcohols with from about 1 to 25 moles of ethylene oxide. The alkyl chain of the aliphatic alcohol can either be straight or branched, primary or secondary, and generally contains from about 8 to about 22 carbon atoms. In an embodiment, the alkyl group contains from about 10 to about 20 carbon atoms with from about 4 to about 10 moles of ethylene oxide per mole of alcohol. Examples of such ethoxylated alcohols include the condensation product of myristyl alcohol with about 10 moles of ethylene oxide per mole of alcohol; and the condensation product of coconut alcohol (a mixture of fatty alcohols with alkyl chains varying in length from 10 to 14 carbon atoms) with about 9 moles of ethylene oxide. Examples of commercially available nonionic surfactants of this type include Tergitol 15-S-9 (the condensation product of $C_{11}$-$C_{15}$ linear alcohol with 9 moles ethylene oxide), marketed by Union Carbide Corporation; Neodol 45-9 (the condensation product of $C_{14}$-$C_{15}$ linear alcohol with 9 moles of ethylene oxide, Neodol 23-6.5 (the condensation product of $C_{12}$-$C_{13}$ linear alcohol with 6.5 moles of ethylene oxide), Neodol 45-7 (the condensation product of $C_{14}$-$C_{15}$ linear alcohol with 7 moles of ethylene oxide), and Neodol 45-4 (the condensation product of $C_{14}$-$C_{15}$ linear alcohol with 4 moles of ethylene oxide), marketed by Shell Chemical Company.

3. The condensation products of ethylene oxide with a hydrophobic base formed by the condensation of propylene oxide with propylene glycol. The hydrophobic portion of these compounds has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants, marketed by Wyandotte Chemical Corporation.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

5. Semi-polar nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

In an embodiment, semi-polar nonionic detergent surfactants are the amine oxide surfactants having the formula:

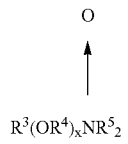

$R^3(OR^4)_xNR^5_2$ wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. $R^5$ groups can be attached to each other, e.g., through an oxygen or nitrogen atom, to form a ring structure.

In an embodiment, the amine oxide surfactants are $C_{10}$-$C_{18}$ alkyldimethylamine oxides and $C_8$-$C_{12}$ alkoxyethyldihydroxyethylamine oxides.

6. Alkylpolysaccharides disclosed in U.S. Pat. No. 4,565,647, Llenado, issued Jan. 21, 1986, having a hydrophobic group containing from about 6 to about 30 carbon atoms, such as from about 10 to about 16 carbon atoms and a polysaccharide, e.g., a polyglycoside, hydrophilic group containing from about 1½ to about 10, such as from about 1½ to about 3, such as from about 1.6 to about 2.7 saccharide units. Any reducing saccharide containing 5 or 6 carbon atoms can be used, e.g., glucose, galactose, and galactosyl moieties can be substituted for the glucosyl moieties. (Optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6-positions on the preceding saccharide units.

Optionally, there can be a polyalkylene oxide chain joining the hydrophobic moiety and the polysaccharide moiety. In an embodiment, the alkyleneoxide is ethylene oxide. Typical hydrophobic groups include alkyl groups, either saturated or unsaturated, branched or unbranched containing from about 8 to about 18, such as from about 10 to about 16 carbon atoms. In an embodiment, the alkyl group is a straight chain saturated alkyl group. The alkyl group can contain up to 3 hydroxy groups and/or the polyalkyleneoxide chain can contain up to about 10, such as less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglycosides. The preferred alkylpolyglycosides have the formula:

$R^2O(C_nH_{2n}O)_t(\text{glycosyl})_x$ wherein $R^2$ is selected from the group consisting of alkyl, alkylphenyl, hydroxyalkyl, hydroxyalkylphenyl, and mixtures thereof in which the alkyl groups contain from about 10 to about 18, such as from about 12 to about 14, carbon atoms; n is 2 or 3, such as 2; t is from 0 to about 10, such as 0; and x is from about 1½ to about 10, such from about 1½ to about 3 and from about 1.6 to about 2.7. The glycosyl may be derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, such as predominately the 2-position.

7. The fatty acid amide surfactants having the formula:

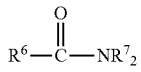

wherein $R^6$ is an alkyl group containing from about 7 to about 21 (such as from about 9 to about 17) carbon atoms and each, $R^7$ is selected from the group consisting of hydrogen, $C_1$-$C_4$ alkyl, $C_1$-$C_4$ hydroxyalkyl, and —$(C_2H_4O)_xH$ where x varies from about 1 to about 3.

In an embodiment, amides are $C_8$-$C_{20}$ ammonia amides, monoethanolamides, diethanolamides, and isopropanolamides.

8. The polyhydroxy fatty acid amide surfactants (alkyl glycamides) having the formula:

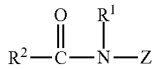

wherein: $R^1$ is H, $C_1$-$C_4$ hydrocarbyl, 2-hydroxyethyl, 2-hydroxypropyl, or a mixture thereof, such as $C_1$-$C_4$ alkyl, such as $C_1$ or $C_2$ alkyl, such as $C_1$ alkyl (i.e., methyl); and $R^2$ is a $C_5$-$C_{31}$ hydrocarbyl, such as straight chain $C_7$-$C_{19}$ alkyl or alkenyl, such as straight chain $C_9$-$C_{17}$ alkyl or alkenyl, such as straight chain $C_{11}$-$C_{15}$ alkyl or alkenyl, or mixtures thereof; and Z is a polyhydroxyhydrocarbyl having a linear hydrocarbyl chain with at least 3 hydroxyl groups directly connected to the chain, or an alkoxylated derivative (such as ethoxylated or propoxylated) thereof. Z may be derived from a reducing sugar in a reductive amination reaction; such as Z will be a glycityl. Suitable reducing sugars include glucose, fructose, maltose, lactose, galactose, mannose, and xylose. As for raw materials, high dextrose corn syrup, high fructose corn syrup, and high maltose corn syrup can be utilized as well as the individual sugars listed above. These corn syrups may yield a mixture of sugar components for Z. It should be understood that it is by no means intended to exclude other suitable raw materials. Z may be selected from the group consisting of —$CH_2$—$(CHOH)_n$—$CH_2OH$, —CH($CH_2OH$)—$(CHOH)_{n-1}$—$CH_2OH$, —$CH_2$—$(CHOH)_2$, (CHOR')(CHOH)—$CH_2OH$, and alkoxylated derivatives thereof, where n is an integer from 3 to 5, (inclusive) and R' is H or a cyclic or aliphatic monosaccharide. In an embodiment, glycityls have n as 4, such as —$CH_2$—$(CHOH)_4$—$CH_2OH$.

In the above formula R' can be, for example, N-methyl, N-ethyl, N-propyl, N-isopropyl, N-butyl, N-2-hydroxyethyl, or N-2-hydroxypropyl. $R^2$—CO—N< can be, for example, cocamide, stearamide, oleamide, lauramide, myristamide, capricamide, palmitamide, tallowamide, etc. Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

9. The N-alkoxy and N-aryloxy polyhydroxy fatty acid amide surfactants (alkyl glycamides) having the formula:

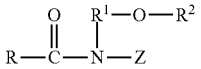

wherein R is $C_7$-$C_{21}$ hydrocarbyl, such as $C_9$-$C_{17}$ hydrocarbyl, including straight-chain (preferred), branched-chain alkyl and alkenyl, as well as substituted alkyl and alkenyl, e.g., 12-hydroxy oleic, or mixtures thereof; $R^1$ is $C_2$-$C_8$ hydrocarbyl including straight-chain, branched-chain and cyclic (including aryl), such as $C_2$-$C_4$ alkylene, i.e., —$CH_2CH_2$—, —$CH_2CH_2CH_2$— and —$CH_2(CH_2)_2CH_2$—; and $R^2$ is $C_1$-$C_8$ straight-chain, branched-chain and cyclic hydrocarbyl including aryl and oxyhydrocarbyl, such as $C_1$-$C_4$ alkyl or phenyl; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (such as ethoxylated or propoxylated) thereof. Z may be derived from a reducing sugar in a reductive amination reaction; in an embodiment, Z is a glycityl moiety. Suitable reducing sugars include glucose, fructose, maltose, lactose, galactose, mannose, and xylose, as well as glyceraldehyde. As for raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z may be selected from the group consisting of —$CH_2$—$(CHOH)_n$—$CH_2OH$, —CH($CH_2OH$)—$(CHOH)_{n-1}$—$CH_2OH$, —$CH_2$—$(CHOH)_2$, (CHOR')(CHOH)—$CH_2OH$, where n is an integer from 1 to 5, inclusive, and R' is H or a cyclic mono- or polysaccharide, and alkoxylated derivatives thereof. In an embodiment, glycityls have n as 4, such as —$CH_2$—$(CHOH)_4$—$CH_2OH$.

In compounds of the above formula, nonlimiting examples of the amine substituents group —$R^1$—O—$R^2$ can be, for example: 2-methoxyethyl-, 3-methoxy-propyl-, 4-methoxybutyl-, 5-methoxypentyl-, 6-methoxyhexyl-, 2-ethoxyethyl-, 3-ethoxypropyl-, 2-methoxypropyl, methoxybenzyl-, 2-isopropoxyethyl-, 3-isopro-poxypropyl-, 2-(t-butoxy)ethyl-, 3-(t-butoxy)propyl-, 2-(isobutoxy)ethyl-, 3-(iso-butoxy)propyl-, 3-butoxypropyl, 2-butoxyethyl, 2-phenoxyethyl-, methoxycyclohexyl-, methoxycyclohexylmethyl-, tetrahydrofurfuryl-, tetrahydropyranyl-oxyethyl-, 3-[2-methoxyethoxy]propyl-, 2-[2-methoxyethoxy]ethyl-, 3-[3-methoxypropoxy]propyl-, 2-[3-methoxypropoxy]ethyl-, 3-[methoxypolyethyleneoxy]propyl-, 3-[4-methoxybutoxy]propyl-, 3-[2-methoxyisopropoxy]propyl-, $CH_3O$—$CH_2CH(CH_3)$— and $CH_3O$—$CH_2CH(CH_3)CH_2$—O—$(CH_2)_3$—. R—CO—N<can be, for example, cocamide, stearamide, oleamide, lauramide, myristamide, capricamide, palmitamide, tallowamide, ricinolamide, etc. Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

10. The aldonamides and aldobionamides disclosed in U.S. Pat. Nos. 5,296,588; 5,336,765; 5,386,018; 5,389,279; 5,401,426 and 5,401,839 as well as WO 94/12511 which are all incorporated herein by reference.

Aldobionamides are defined as the amide of an aldobionic acid (or aldobionolactone) and an aldobionic acid is a sugar substance (e.g., any cyclic sugar comprising at least two saccharide units) wherein the aldehyde group (generally found at the $C_1$ position of the sugar) has been replaced by a carboxylic acid, which upon drying cyclizes do an aldonolactone.

An aldobionamide may be based on compounds comprising two saccharide units (e.g., lactobionamides or maltobionamides, etc.) or they may be based on compounds comprising more than two saccharide units (e.g., maltotrionamides), as long as the terminal sugar in the polysaccharide has an aldehyde group. By definition an aldobionamide must have at least two saccharide units and cannot be linear. In an embodiment, the disaccharide compounds are lactobionamides or maltobionamides. Other examples of aldobionamides (disaccharides) which may be used include cellobionamides, melibionamides and gentiobionamides.

A specific example of an aldobionamide which may be used is the disaccharide lactobionamide set forth below:

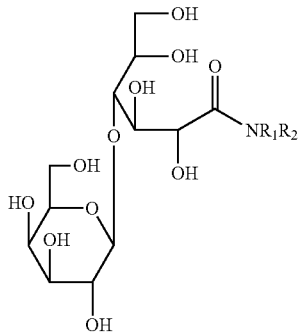

wherein $R_1$ and $R_2$ are the same or different and are selected from the group consisting of hydrogen; an aliphatic hydrocarbon radical (e.g., alkyl groups and alkene groups which groups may contain heteroatoms such as N, O or S or alkoxylated alkyl chains such as ethoxylated or propoxylated alkyl groups, preferably an alkyl group having 6 to 24, preferably 8 to 18 carbons; an aromatic radical (including substituted or unsubstituted aryl groups and arenes); a cycloaliphatic radical; an amino acid ester, ether amines and mixtures thereof. It should be noted that $R_1$ and $R_2$ cannot be hydrogen at the same time.

B. Anionic Surfactants

Certain anionic surfactants suitable for use in the present disclosure are generally disclosed in U.S. Pat. No. 3,929,678, at column 23, line 58 through column 29, line 23, incorporated herein by reference. Classes of useful anionic surfactants include:

1. Ordinary alkali metal soaps, such as the sodium, potassium, ammonium and alkylolammonium salts of higher fatty acids containing from about 8 to about 24 carbon atoms, such as from about 10 to about 20 carbon atoms. In an embodiment, alkali metal soaps are sodium laurate, sodium cocoate, sodium stearate, sodium oleate, and potassium palmitate, as well as fatty alcohol ether methylcarboxylates and their salts.

2. Water-soluble salts, such as the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups).

Examples of this group of anionic surfactants are the sodium and potassium alkyl sulfates, especially those obtained by sulfating the higher alcohol ($C_8$-$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. No. 2,220,099 and U.S. Pat. No. 2,477,383. In an embodiment, the anionic surfactant is a linear straight chain alkylbenzene sulfonates in which the average number of carbon atoms in the alkyl group is from about 11 to about 13, abbreviated as $C_{11}$-$C_{13}$ LAS.

Another group of anionic surfactants of this type are the alkyl polyalkoxylate sulfates, such as those in which the alkyl group contains from about 8 to about 22, such as from about 12 to about 18 carbon atoms, and wherein the polyalkoxylate chain contains from about 1 to about 15 ethoxylate and/or propoxylate moieties, such as from about 1 to about 3 ethoxylate moieties. These anionic detergent surfactants are desirable for formulating heavy-duty liquid laundry detergent compositions.

Other anionic surfactants of this type include sodium alkyl glyceryl ether sulfonates, such as those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 15 units of ethylene oxide per molecule and wherein the alkyl group contains from about 8 to about 22 carbon atoms.

Also included are water-soluble salts of esters (including, but not limited to, methyl esters) of alpha-sulfonated fatty acids containing from about 6 to about 20 carbon atoms (for example, about 12, about 14, about 16, or about 18, and such as about 16 or about 18, carbon atoms) in the fatty acid group and from about 1 to about 10 carbon atoms in the ester group; suitable such alpha-sulphonated fatty acid esters are described, for example, in U.S. Pat. Nos. 6,057,280; 6,288,020; 6,407,050; 6,468,956; 6,509,310; 6,534,464; 6,683,039; 6,764,989; 6,770,611; 6,780,830; 7,387,992; and 7,479,165; all of which are incorporated herein by reference in their entireties.

Also included are water-soluble salts of 2-acyloxyalkane-1-sulfonic acids containing from about 2 to about 9 carbon atoms in the acyl group and from about 9 to about 23 carbon atoms in the alkane moiety; water-soluble salts of olefin sulfonates containing from about 12 to about 24 carbon atoms; and beta alkyloxy alkane sulfonates containing from about 1 to about 3 carbon atoms in the alkyl group and from about 8 to about 20 carbon atoms in the alkane moiety as well as primary alkane sulfonates, secondary alkane sulfonates, alpha-sulfo fatty acid esters, sulfosuccinic acid alkyl esters, acylaminoalkane sulfonates (Taurides), sarcosinates and sulfated alkyl glycamides, sulfated sugar surfactants, and sulfonated sugar surfactants.

In an embodiment, surfactants for use herein include fatty acid methyl ester sulfonates, alkyl benzene sulfonates, alkyl sulfates, alkyl polyethoxy sulfates, and mixtures thereof. Mixtures of these anionic surfactants with a nonionic surfactant selected from the group consisting of $C_{10}$-$C_{20}$ alcohols ethoxylated with an average of from about 4 to about 10 moles of ethylene oxide per mole of alcohol are suitable.

3. Anionic phosphate surfactants such as the alkyl phosphates and alkyl ether phosphates.

4. N-alkyl substituted succinamates.

C. Ampholytic Surfactants

Ampholytic surfactants can be broadly described as aliphatic derivatives of secondary or tertiary amines, or aliphatic derivatives of heterocyclic secondary and tertiary amines in which the aliphatic radical can be straight or branched chain and wherein one of the aliphatic substituents contains from about 8 to about 18 carbon atoms and at least one of the aliphatic substituents contains an anionic water-solubilizing group, e.g., carboxy, sulfonate or sulfate. See U.S. Pat. No. 3,929,678, column 19, line 38 through column 22, line 48, incorporated herein by reference, for examples of ampholytic surfactants useful herein.

D. Zwitterionic Surfactants

Zwitterionic surfactants can be broadly described as derivatives of secondary and tertiary amines, derivatives of heterocyclic secondary and tertiary amines, or derivatives of quaternary ammonium, quaternary phosphonium, or tertiary sultonium compounds. See, e.g., U.S. Pat. No. 3,929,678, Laughlin et al., issued Dec. 30, 1975, column 19, line 38 through column 22, line 48, incorporated herein by reference, for examples of zwitterionic surfactants.

E. Cationic Surfactants

Cationic surfactants can also be included in detergent compositions of the present disclosure. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate, and hydroxide. Tertiary amines can have characteristics similar to cationic surfactants at washing solutions pH values less than about 8.5.

Suitable cationic surfactants include the quaternary ammonium surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain; each $R^3$ is independently selected from the group consisting of —$CH_2CH_2$—, —$CH_2CH(CH_3)$—, —$CH_2CH(CH_2OH)$—, and —$CH_2CH_2CH_2$—, each $R^4$ is independently selected from the group consisting of $C_1$-$C_4$ alkyl, $C_1$-$C_4$ hydroxyalkyl, benzyl, ring structures formed by joining the two $R^4$groups, —$CH_2CHOHCHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18, each y is from 0 to about 10 and the sum of the y values is from 0 to about 15; and X is any compatible anion.

Examples of the above compounds are the alkyl quaternary ammonium surfactants, such as the monolong chain alkyl surfactants described in the above formula when $R^5$ is selected from the same groups as $R^4$. In an embodiment, the quaternary ammonium surfactants are the chloride, bromide, and methylsulfate $C_8$-$C_{16}$ alkyl trimethylammonium salts, $C_8$-$C_{16}$ alkyl di(hydroxyethyl)methylammonium salts, the $C_8$-$C_{16}$ alkyloxypropyltrimethylammonium salts, and the like, such as decyl trimethylammonium methylsulfate, lauryl trimethylammonium chloride, myristyl trimethylammonium bromide and coconut trimethylammonium chloride and methylsulfate.

A more complete disclosure of cationic surfactants useful herein can be found in U.S. Pat. No. 4,228,044, Cambre, issued Oct. 14, 1980, incorporated herein by reference.

b. Color Care Additive Mixture (b) A color care additive mixture is present in the liquid detergent composition in an amount from about 0.0001 to about 5 weight percent of the total formulation. This includes, for example, from about 0.005 to about 1 weight percent, from about 0.01 to about 0.05 weight percent, and from about 0.1 to about 0.5 weight percent. This includes, for example, about 0.0001 weight percent, about 0.005 weight percent, about 0.001 weight percent, about 0.05 weight percent, about 0.1 weight percent, about 0.2 weight percent, about 0.3 weight percent, about 0.4 weight percent, about 0.5 weight percent, about 0.6 weight percent, about 0.7 weight percent, about 0.8 weight percent, about 0.9 weight percent, about 1 weight percent, about 1.5 weight percent, about 2 weight percent, about 2.5 weight percent, about 3 weight percent, about 3.5 weight percent, about 4 weight percent, about 4.5 weight percent, and about 5 weight percent.

c. Colorant

A colorant may be present in the liquid detergent composition in an amount of at least 0.005 weight percent of the total formulation. This includes, for example, at least 0.01 weight percent, 0.05 weight percent, 0.75 weight percent, 0.1 weight percent, 0.2 weight percent, 0.3 weight percent, 0.4 weight percent, 0.5 weight percent, 0.6 weight percent, 0.7 weight percent, 0.8 weight percent, 0.9 weight percent, 1 weight percent, 1.5 weight percent, 2 weight percent, 2.5 weight percent, 3 weight percent, 3.5 weight percent, 4 weight percent, 4.5 weight percent, and 5 weight percent.

It has been unexpectedly discovered that the addition of a colorant with a color care additive will boost the chlorine scavenging efficacy of a liquid detergent composition of the present disclosure. Accordingly, the liquid detergent compositions of the present disclosure have synergistic chlorine scavenging efficacy.

Also disclosed is a method of laundering fabrics, comprising contacting said fabrics with the liquid detergent compositions disclosed herein. In an embodiment, laundering fabrics comprises agitating fabrics in an aqueous solution containing the liquid detergent composition.

Additional Components of the Compositions

The compositions of the present disclosure may comprise any colorant stabilizer known in the art. In an embodiment, the colorant stabilizer is formic acid, citric acid, lactic acid, acetic acid, ascorbic acid, erythorbic acid, any derivative thereof, or any combination thereof.

The compositions of the present disclosure may comprise any detergency builder known in the art. In an embodiment, the detergency builder is zeolite; alkali metal silicates; alkali metal carbonates; alkali metal phosphates; alkali metal polyphosphates; alkali metal phosphonates; alkali metal polyphosphonic acids; $C_8$-$C_{18}$ alkyl monocarboxylic acids, polycarboxylic acids, alkali metal, ammonium or substituted ammonium salts thereof; and mixtures thereof.

The compositions of the present disclosure may also comprise additional components known in the art. In an embodiment, the additional components comprise solvents, rinse aids, hydrotropes, solubilizing agents, processing aids, soil-suspending agents, corrosion inhibitors, fillers, carriers, germicides, pH-adjusting agents, perfumes, static control agents, thickening agents, abrasive agents, viscosity control agents, solubilizing/clarifying agents, sunscreens/UV absorbers, phase regulants, foam boosting/stabilizing agents, antioxidants, metal ions, buffering agents, color speckles, encapsulation agents, deflocculating polymers, skin protective agents, color care agents, and combinations thereof.

Unit Dose Pack

Compositions of the present disclosure may also be formulated for delivery in a unit dose pack, package, pouch, and the like.

Unitized dose forms may be packs. The pack is typically a closed structure which comprises one or more compartments. Subject to the constraints of dispenser fit, the pack can be of any form, shape, and material which is suitable to hold the composition, e.g. without allowing the release of the composition from the pack prior to contact of the pack to water. The exact execution will depend on, for example, the type and amount of the composition in the pack, the number of compartments in the pack, the characteristics required from the pack to hold, protect, and deliver or release the composition and/or components thereof.

The composition, or components thereof, are contained in the internal volume space of the pack, and are typically separated from the outside environment by a barrier of water-soluble material. Different components of the composition contained in different compartments of the pack may be separated from one another by a barrier of water-soluble material. In an embodiment, the pack has at least one chamber, such as two chambers or three chambers.

In the case of multi-compartment packs, the compartments may be of a different color from each other, for example a first compartment may be green or blue, and a second compartment may be white or yellow. One compartment of the pack may be opaque or semi-opaque, and a second compartment of the pack may be translucent, transparent, or semi-transparent. The compartments of the pack may be the same size, having the same internal volume, or may be different sizes having different internal volumes.

Suitable multi-compartment packs (which term includes capsules, sachets and other compartmentalized unit dose containers) for use herein include water-soluble, water-dispersible and water-permeable packs. In an embodiment, the water soluble packs are based on partially hydrolysed polyvinylacetate/polyvinyl alcohol.

Unit dose packs are known in the art and can be manufactured by methods known in the art. Non-limiting examples of these unit dose packs may be found, for example, in U.S. Pat. Nos. 4,973,416, 5,132,036, 6,037,319, and 8,357,647, each of which is incorporated by reference.

EXAMPLES

The compositions and uses described herein are now further detailed with reference to the following examples. These examples are provided for the purpose of illustration only and the embodiments described herein should in no way be construed as being limited to these examples. Rather, the embodiments should be construed to encompass any and all variations which become evident as a result of the teaching provided herein.

Example 1

Liquid Fabric Conditioner Compositions Blends with HP56K and Ammonium Chloride

A 1000 gram batch was created by mixing deionized water, encapsulated fragrance, rheovis, and dyes. The mixture was mixed under low-shear and heated until 150-160° F. DEEDMAC (diethyloxyester dimethyl ammonium chloride) was separately pre-heated to about 80° C. The pre-heated DEEDMAC was added and the mixture was homogenized under high-shear using a mixer such as a Ross HSM-100LCI with a slotted stator screen for 2 minutes at 3500 rpm. Then, calcium chloride, Sokalan HP56K, and/or ammonium chloride (in the amount as stated in the compositions tested in Table 2) were added and the mixture was homogenized for another minute at 3500 rpm. The solution was cooled to about 140° F. Lactic acid and gluteraldhyde were added and the mixture was mixed under low-shear. After cooling below 110° F., neat oil fragrance was added and the mixture was mixed under low shear. Deionized water was added until the batch totaled 1000 grams, and mixing was continued under low-shear.

Table 1

Liquid Fabric Conditioner Compositions

Table 1 shows liquid fabric conditioner compositions.

| Component | Temperature (° F.) | Activity (%) | Amount (wt. %) |
|---|---|---|---|
| Deionized water | 150-160 | 100 | 65 |
| Necta Bloom UAC03177/00 (encapsulated fragrance) | | 100 | 0.3 |
| Rheovis CDE | | 50 | 0.02 |

-continued

| Component | Temperature (° F.) | Activity (%) | Amount (wt. %) |
|---|---|---|---|
| Violet LS | | 1 | 0.0003 |
| Royal MC | | 1 | 0.0011 |
| DEEDMAC | | 82 | 9.25 |
| Calcium Chloride | | 10 | as stated |
| Sokalan HP56K | | 30 | as stated |
| Ammonium Chloride | | 100 | as stated |
| Lactic Acid | | 88 | 0.1 + amount needed to adjust pH to ~ 2.75 |
| Glutaraldehyde | | 50 | 0.07 |
| Blue Sky Breeze MOD 2 UAE15801/00 (Neat Oil Fragrance) | | 100 | 0.2 |
| Water | | | QS |
| Total wt. | | 100 | to 100 |

Table 2

Viscosity and Stability of Liquid Fabric Conditioner Compositions

Table 2 shows viscosity and stability comparisons of the liquid fabric conditioner compositions of Table 1. In Table 2, the Instability Index ("ISI") refers to the number generated by the LUMiSizer® instrument. The ISI number ranges from 0 to 1, with 0 being no separation (i.e., no instability) and 1 being complete separation (i.e., no stability). The LUMiSizer® determines instability by determining the difference in light transmission throughout the sample vial at time zero to the end of the test. The instrument compares transparency value differences to determine overall instability.

To run the LUMiSizer®, 400 microliters of product was placed in a 2 mm polycarbonate cell (made by LUM, #110-131xx). The cells were loaded into the LUMiSizer® instrument and spun at 1500 g-force for approximately 40 minutes at 25° C. with a light factor of 1. Using LUM's SEPview program, the ISI was calculated.

| % of $NH_4Cl$ by weight | % of Sokalan HP56K by weight | % of $CaCl_2$ (10%) by weight | Viscosity at 70 F (cP) | Time to Failure at 113 ° F. | Time to Failure at 105 ° F. | Time to Failure at 75 ° F. | Time to Failure at 40 ° F. | Particle Size | pH | ISI # (LUMiSizer) |
|---|---|---|---|---|---|---|---|---|---|---|
| 0 | 0 | 0.0115 | 152 | | No Failure at 8 Weeks | | | 6.55 | 2.77 | 0.056 |
| 0.1 | 0 | 0 | 7.5 | 0 | 0 | 0 | 0 | 7.4 | 2.75 | — |
| 0.1 | 0.0343 | 0.0129 | 20 | 1 | 1 | 1 | 1 | 7.38 | 2.76 | — |
| 0.1 | 0.4677 | 0.0226 | 52.5 | 1 | 1 | 1 | 1 | 5.27 | 2.72 | — |
| 0.1 | 0.3464 | 0.0326 | 20 | 1 | 1 | 1 | 1 | 6.3 | 2.76 | — |
| 0.1 | 0.4046 | 0.0030 | 165 | 6 | 6 | Not Separated at 8 Weeks | Not Separated at 8 Weeks | 5.82 | 2.8 | 0.379 |
| 0.1 | 0.0926 | 0.0277 | 15 | 1 | 1 | 1 | 1 | 5.4 | 2.91 | — |
| 0.1 | 0.2177 | 0.0374 | 15 | 1 | 1 | 1 | 1 | 5.26 | 3.03 | — |
| 0.1 | 0.2818 | 0.0175 | 17.5 | 1 | 1 | 1 | 1 | 6.13 | 2.76 | — |
| 0.1 | 0.1599 | 0.0074 | 42.5 | Not Separated at 8 Weeks | 6 | Not Separated at 8 Weeks | 4 | 5.95 | 2.82 | 0.355 |
| 0.1 | 0.25 | 0 | 90 | | No Failure at 8 Weeks | | | 6.3 | 2.86 | 0.12 |
| 0.1 | 0.4 | 0 | 185 | 3 | 3 | 3 | Not Separated at 8 Weeks | 5.84 | 2.92 | 0.36 |
| 0.1 | 0.5 | 0.02 | 61.25 | 1 | 3 | 6 | 7 | 5.39 | 2.98 | — |
| 0.1 | 0.5 | 0.04 | 27.5 | 1 | 1 | 1 | 1 | 5.85 | 2.89 | — |

-continued

| % of $NH_4Cl$ by weight | % of Sokalan HP56K by weight | % of $CaCl_2$ (10%) by weight | Viscosity at 70 F (cP) | Time to Failure at 113 ° F. | Time to Failure at 105 ° F. | Time to Failure at 75 ° F. | Time to Failure at 40 ° F. | Particle Size | pH | ISI # (LUM-iSizer) |
|---|---|---|---|---|---|---|---|---|---|---|
| 0.1 | 0.3 | 0 | 147.5 | 3 | 3 | Not Separated at 8 Weeks | Not Separated at 8 Weeks | 6.08 | 2.94 | 0.096 |
| 0.1 | 0.35 | 0 | 265 | | No Failure at 8 Weeks | | | 5.75 | 2.99 | 0.154 |
| 0.1 | 0.5 | 0 | 415 | 1 | 1 | 3 | 5 | 8.1 | 2.69 | — |
| 0.1 | 0.5 | 0.0105 | 270 | 1 | 1 | 1 | 1 | 6.08 | 3.1 | — |
| 0.05 | 0.25 | 0 | 315 | | No Failure at 8 Weeks | | | 7.10 | 2.79 | — |
| 0.05 | 0.125 | 0 | 212.5 | | No Failure at 8 Weeks | | | 7.13 | 2.96 | — |
| 0.05 | 0 | 0.0055 | 132.5 | | No Failure at 8 Weeks | | | 7.17 | 2.91 | 0.053 |
| 0.05 | 0.25 | 0.0055 | 215 | | No Failure at 8 Weeks | | | 7.17 | 3.17 | 0.131 |
| 0.05 | 0.125 | 0.0055 | 100 | | No Failure at 8 Weeks | | | 7.17 | 2.77 | 0.075 |

As shown in Table 2, the addition of Sokalan HP56K to fabric conditioners containing $NH_4C_1$ increased the viscosity of the product to an acceptable level (i.e. 70 to 300 cP). Sokalan HP56K also enhanced the overall stability of the product by increasing the time to failure from 0 days to more than 8 weeks in storage at multiple temperatures. The ISI numbers showed that there may be an optimal ratio of Ammonium Chloride to Sokalan HP56K to enable the most stable formula. A ratio of about 1:2 to 1:6 of Ammonium Chloride:Sokalan HP56K gave the best stability.

Example 2

Salt Curves for Liquid Fabric Conditioner Compositions

A 1000 gram batch was created by combining deionized water, encapsulated fragrance, rheovis, and dyes. The combination was mixed under low-shear and heated until 150-160° F. DEEDMAC was added and the combination was homogenized under high-shear using a mixer such as a Ross HSM-100LCI with a slotted stator screen for 2 minutes at 3500 rpm. Then, calcium chloride, Sokalan HP56K, Lupasol FG, and/or ammonium chloride (in the amount as shown in the compositions tested in Table 4) were added and the combination was homogenized for another minute at 3500 rpm. The solution was cooled to about 140° F. Lactic acid and gluteraldhyde were added and the combination was mixed under low-shear. After cooling below 110° F., the neat oil fragrance was added and the combination was mixed under low-shear. Deionized water was added until the batch totaled 1000 grams, and mixing was continued under low-shear.

Table 3

Liquid Fabric Conditioner Compositions

Table 3 shows liquid fabric conditioner compositions.

| Component | Activity (%) | Amount (wt. %) |
|---|---|---|
| DI water | 100 | 65 |
| Necta Bloom UAC03177/00 (encapsulated fragrance) | 100 | 0.3 |
| Rheovis CDE | 50 | 0.02 |
| Violet LS | 1 | 0.0003 |
| Royal MC | 1 | 0.0011 |
| DEQ | 82 | 9.25 |
| Calcium Chloride | 10 | as stated |

-continued

| Component | Activity (%) | Amount (wt. %) |
|---|---|---|
| Sokalan HP56K | 30 | as stated |
| Lupasol FG | 98 | as stated |
| Ammonium Chloride | 100 | as stated |
| Lactic Acid | 88 | 0.1 + amount needed to adjust pH to ~ 2.75 |
| Glutaraldehyde | 50 | 0.07 |
| Blue Sky Breeze MOD 2 UAE15801/00 (Neat Oil Fragrance) | 100 | 0.2 |
| Water | | QS |
| Total wt. | 100 | to 100 |

Table 4

Viscosity of Liquid Fabric Conditioner Compositions

Table 4 shows viscosity comparisons of the liquid fabric conditioner compositions of Table 3.

| Formula Type | Initial Viscosity (cP) | mL of (2%) Calcium Chloride added to reach 70 cP when added to a 225 g Sample |
|---|---|---|
| Negative Control (no Calcium Chloride; pH 2.80) | 1816 | 1.2 |
| Control Formula (with 10% Calcium Chloride; pH 2.80) | 122.5 | 0.125 |
| 0.1% $NH_4Cl$ + 0.5% Sokalan HP56K (with Lactic Acid to Neutralize to pH 2.80) | 415 | 3.5 |
| 0.5% $NH_4Cl$ +1% Sokalan HP56K (with Lactic Acid to Neutralize to pH 2.80) | 245 | 5.25 |
| 0.34% Lupasol + 1% Sokalan HP56K (with Lactic Acid to Neutralize to pH 2.80) | 195 | 7.25 |
| 0.1% Lupasol + 0.5% Sokalan HP56K (with Lactic Acid to Neutralize to pH 2.80) | 95 | 1 |

-continued

| Formula Type | Initial Viscosity (cP) | mL of (2%) Calcium Chloride added to reach 70 cP when added to a 225 g Sample |
|---|---|---|
| 0.5% Sokalan HP56K (with Lactic Acid to Neutralize to pH 2.80) | 560 | 4 |
| 1% Sokalan HP56K (with Lactic Acid to Neutralize to pH 2.80) | 856 | 10 |
| 0.1% Lupasol + 1% Sokalan HP56K (with Lactic Acid to Neutralize to pH 2.80) | 472 | 14 |

As shown in Table 4, there is an advantage of using Sokalan HP56K with Ammonium Chloride or Lupasol FG in a Liquid Fabric Conditioner. For the samples including Sokalan HP56K with either Ammonium Chloride or Lupasol FG, the slope of viscosity reduction was not as steep as the sample having only calcium chloride. This showed a reduction in the risk of improperly modifying viscosity in a liquid fabric conditioner composition and showed a more robust formula for viscosity adjustment.

Example 3

Colorants as Chlorine Scavengers

Using a standard top loading machine, approximately 63.5 liters of 120 ppm water ($Ca^{2+}$:$Mg^{2+}$ in a 3:1 ratio) with 0 ppm of Chlorine was added to the machine at 59° F. A chlorine sensor was placed in the wash and 0.713 mL of 14.5% Sodium Hypochlorite solution was added. The liquid was agitated in the water for 1 minute. Agitation continued until the chlorine sensor registered the water as 1 ppm chlorine. The colorant was then added into the wash. The washing machine continued to agitate the wash. The chlorine value was recorded every 2 seconds for 12 minutes. The recorded data was graphed to determine the difference (delta) in chlorine and the slope of chlorine reduction.

Table 5

Colorant Wash Analyzer

Table 5 shows comparisons of the chlorine scavenging potential of the recited colorants.

| Raw Material | Use-level (grams) | Delta Chlorine from 1 ppm initial (ppm) | Slope |
|---|---|---|---|
| Acid Blue 9 | 0.1 | 0 | 0 |
| Acid Blue 80 | 0.1 | 0.31 | −0.033 |
| Yellow 5 | 0.1 | 0.27 | −0.18 |
| Red 40 | 0.1 | 0.14 | −0.015 |

As shown in Table 5, Acid Blue 9 did not scavenge any chlorine, but Acid Blue 80, Yellow 5, and Red 40 scavenged 0.31, 0.27, and 0.14 ppm of the 1 ppm chlorine dosed into the system.

Example 4

Phabrometer Analysis

Reactive Blue woven fabrics were washed 15 times with Commercial Detergent 1, Commercial Detergent 1/Commercial Liquid Fabric Softener 2, Commercial Detergent 1/Commercial Liquid Fabric Softener 2 and Sokalan HP 56K, or Commercial Detergent 1/Commercial Liquid Fabric Softener 2 and Lupasol FG. A standard top loader was used. The water temperature was 90° F. and contained 120 ppm Ca/Mg and 1 ppm Cl. After the 15 washes, a phabrometer was used to measure the Stiffness, Softness, Smoothness, Drape, and Wrinkle Recovery of the fabric.

TABLE 6

Fabric Properties after 15 Washes

| Level | Least Sq. Mean |
|---|---|
| Resilience (Stiffness) | |
| Commercial Detergent 1 A | 43.003900 |
| Commercial Detergent 1 + Commercial Liquid A Fabric Softener 1 | 43.522207 |
| Commercial Detergent 1 + Commercial Liquid B Fabric Softener 2 | 43.100733 |
| Commercial Detergent 1 + Commercial Liquid B C Fabric Softener 2 + Lupasol + Lactic Acid | 43.030933 |
| Commercial Detergent 1 + Commercial Liquid C Fabric Softener 2 + Sokalan + Lactic Acid | 42.804400 |
| Commercial Detergent 1 + Commercial Liquid C Fabric Softener 2 + $NH_4Cl$ | 42.787007 |
| Softness | |
| Commercial Detergent 1 + Commercial Liquid Fabric A Softener 2 + Sokalan + Lactic Acid | 88.008533 |
| Commercial Detergent 1 + Commercial Liquid Fabric A B Softener 2 + $NH_4Cl$ | 88.442107 |
| Commercial Detergent 1 + Commercial Liquid Fabric B Softener 2 + Lupasol + Lactic Acid | 88.218133 |
| Commercial Detergent 1 + Commercial Liquid Fabric B Softener 2 | 88.181300 |
| Commercial Detergent 1 + Commercial Liquid Fabric C Softener 1 | 87.040100 |
| Commercial Detergent 1 C | 87.300333 |
| Smoothness | |
| Commercial Detergent 1 A | 83.215100 |
| Commercial Detergent 1 + Commercial Liquid Fabric A B Softener 1 | 82.013033 |
| Commercial Detergent 1 + Commercial Liquid Fabric A B Softener 2 + Sokalan + Lactic Acid | 82.824333 |
| Commercial Detergent 1 + Commercial Liquid Fabric A B Softener 2 + $NH_4Cl$ | 82.792133 |
| Commercial Detergent 1 + Commercial Liquid Fabric B Softener 2 | 82.714133 |
| Commercial Detergent 1 + Commercial Liquid Fabric B Softener 2 + Lupasol + Lactic Acid | 82.661467 |
| Drape | |
| Commercial Detergent 1 A | 5.1130000 |
| Commercial Detergent 1 + Commercial Liquid Fabric A Softener 1 | 4.9476667 |
| Commercial Detergent 1 + Commercial Liquid Fabric B Softener 2 | 4.6143333 |
| Commercial Detergent 1 + Commercial Liquid Fabric B Softener 2 + Lupasol + Lactic Acid | 4.5823333 |
| Commercial Detergent 1 + Commercial Liquid Fabric B C Softener 2 + $NH_4Cl$ | 4.4406667 |
| Commercial Detergent 1 + Commercial Liquid Fabric C Softener 2 + Sokalan + Lactic Acid | 4.3520000 |
| Wrinkle Recovery (Elastic Recoverability) | |
| Commercial Detergent 1 + Commercial Liquid A Fabric Softener 2 + Lupasol + Lactic Acid | 76.820000 |
| Commercial Detergent 1 + Commercial Liquid A Fabric Softener 2 + $NH_4Cl$ | 76.073333 |

TABLE 6-continued

| Fabric Properties after 15 Washes | |
|---|---|
| Level | Least Sq. Mean |
| Commercial Detergent 1 + Commercial Liquid A Fabric Softener 2 + Sokalan + Lactic Acid | 75.556667 |
| Commercial Detergent 1 + Commercial Liquid A B Fabric Softener 2 | 74.700000 |
| Commercial Detergent 1 + Commercial Liquid B Fabric Softener 1 | 71.946667 |
| Commercial Detergent 1 C | 66.303333 |

Table 6 shows comparisons of the resilience (stiffness), softness, smoothness, drape, and wrinkle recovery (elastic recoverability) of formulations. The results of the analysis are qualitatively measured by the letters "A," "B," and "C." Formulations having the same letter have a statistically similar property. Formulations having a different letter have a statistically different property. For example, the resilience of a formulation having the designation "A" will be a statistically different than the resilience of a formulation having the designation "B." For example, if a formulation has both "A" and "B" designations for resilience, it shares statistically similar resilience as a formulation designated as "A" and a formulation designated as "B." The letters have no relationship to desirability (i.e., a resilience of "A" is not necessarily a more desirable resilience than a resilience of "B"). As shown in Table 6, the addition of Sokalan HP 56K significantly improved drape, stiffness, and softness, as compared to Commercial Detergent 1/Commercial Liquid Fabric Softener 2 alone.

Having now fully described this disclosure, it will be understood by those of ordinary skill in the art that the same can be performed within a wide and equivalent range of conditions, formulations, and other parameters without affecting the scope of the invention or any embodiment thereof.

Other embodiments of the disclosure will be apparent to those skilled in the art from consideration of the specification and practice of the invention disclosed herein. It is intended that the specification and examples be considered exemplary only, with a true scope and spirit of the invention being indicated by the following claims.

All patents, patent applications, and publications cited herein are fully incorporated by reference herein in their entirety.

What is claimed is:

1. A fabric conditioner composition having a viscosity of from 70 to 315 cP and comprising:

a. from about 5 to about 25 weight percent actives of a quaternary cationic ammonium fabric softener; and b. from about 0.05 about 0.5 weight percent actives of a color care additive mixture comprising (i) ammonium chloride and (ii) a polyvinylpyrrolidone-vinylimidazole copolymer.

2. The fabric conditioner composition of claim 1, further comprising at least 0.005 weight percent of a colorant.

3. The fabric conditioner composition of claim 2, further comprising a colorant stabilizer selected from the group consisting of formic acid, citric acid, lactic acid, acetic acid, ascorbic acid, erythorbic acid, any derivative thereof, or any combination thereof.

4. The fabric conditioner composition of claim 1 having a viscosity of from 70 to 300 cP.

5. The fabric conditioner composition of claim 4 wherein the quaternary ammonium cationic fabric softener is diethyloxyester dimethyl ammonium chloride.

6. The fabric conditioner composition of claim 5 wherein the ratio of ammonium chloride to the polyvinylpyrrolidone-vinylimidazole copolymer is about 1:2 to 1:6.

7. The fabric conditioner composition of claim 1 wherein the quaternary ammonium cationic fabric softener is diethyloxyester dimethyl ammonium chloride.

8. The fabric conditioner composition of claim 1 wherein the polyvinylpyrrolidone-vinylimidazole copolymer is present in an amount of from 0.0375 to 0.15 weight percent actives.

9. The fabric conditioner composition of claim 1 wherein the ammonium chloride is present in an amount of from 0.05 to 0.1 weight percent actives.

10. The fabric conditioner composition of claim 1 further comprising calcium chloride in an amount of from 0.0003 to 0.00105 weight percent actives.

11. The fabric conditioner composition of claim 1 wherein the polyvinylpyrrolidone-vinylimidazole copolymer is present in an amount of from 0.0375 to 0.15 weight percent actives and wherein the ammonium chloride is present in an amount of from 0.05 to 0.1 weight percent actives.

12. The fabric conditioner composition of claim 1 wherein the polyvinylpyrrolidone-vinylimidazole copolymer is present in an amount of from 0.0375 to 0.15 weight percent actives and wherein the ammonium chloride is present in an amount of from 0.05 to 0.1 weight percent actives, and further comprising calcium chloride in an amount of from 0.0003 to 0.00105 weight percent actives.

13. The fabric conditioner composition of claim 12 wherein the quaternary cationic ammonium fabric softener is present in an amount of from 7.5 to about 17.5 weight percent actives.

14. The fabric conditioner composition of claim 13 wherein the quaternary cationic ammonium fabric softener is diethyloxyester dimethyl ammonium chloride.

15. The fabric conditioner composition of claim 1 wherein the ratio of ammonium chloride to the polyvinylpyrrolidone-vinylimidazole copolymer is about 1:2 to 1:6.

16. The fabric conditioner composition of claim 1 wherein the quaternary cationic ammonium fabric softener is present in an amount of from 7.5 to about 17.5 weight percent actives.

17. The fabric conditioner composition of claim 16 wherein the quaternary cationic ammonium fabric softener is diethyloxyester dimethyl ammonium chloride.

18. The fabric conditioner composition of claim 1 wherein the quaternary cationic ammonium fabric softener is diethyloxyester dimethyl ammonium chloride.

19. A fabric conditioner composition having a viscosity of from 70 to 315 cP and consisting of:

65 weight percent deionized water;

0.5 weight percent actives of an encapsulated fragrance;

0.01 weight percent actives of a rheology modifier;

0.00001 weight percent actives of a colorant;

7.6 weight percent actives of diethyloxyester dimethyl ammonium chloride;

0.0003 to 0.00105 weight percent actives of calcium chloride;

0.0375 to 0.15 weight percent actives of a polyvinylpyrrolidone-vinylimidazole copolymer;

0.05 to 0.1 weight percent actives of ammonium chloride;

a sufficient amount of lactic acid to adjust a pH of said composition to about 2.75;

0.035 weight percent actives of glutaraldehyde; and quantum satis (q.s.) water to reach 100 total parts, wherein each weight percent is based on a total weight of said fabric conditioner composition.

* * * * *